US005156532A

United States Patent [19]

Arndt et al.

[11] Patent Number: 5,156,532

[45] Date of Patent: Oct. 20, 1992

[54] ROTARY VANE VACUUM PUMP WITH SHAFT SEAL

[75] Inventors: Lutz Arndt, Troisdorf; Peter Müller, Cologne; Dieter Vorberg, Erftstadt, all of Fed. Rep. of Germany

[73] Assignee: Leybold AG, Hanau, Fed. Rep. of Germany

[21] Appl. No.: 707,040

[22] Filed: May 29, 1991

[30] Foreign Application Priority Data

May 29, 1990 [DE] Fed. Rep. of Germany ..... 4017194

[51] Int. Cl.[5] ..... F04C 25/02

[52] U.S. Cl. ..... 417/360; 277/59; 403/356; 418/104

[58] Field of Search ..... 277/58, 59; 403/355, 403/356; 418/104; 417/360

[56] References Cited

U.S. PATENT DOCUMENTS

| | | | |
|---|---|---|---|
| 4,162,137 | 7/1979 | Bjerke | 277/59 |
| 4,311,440 | 1/1982 | Eberhardt | 418/104 |
| 4,669,738 | 6/1987 | Netzel | 277/59 |
| 4,737,087 | 4/1988 | Hertell | 418/104 |
| 5,022,836 | 6/1991 | Tokumitsu et al. | 418/104 |

FOREIGN PATENT DOCUMENTS 2354039 5/1975 Fed. Rep. of Germany .

*Primary Examiner*—John J. Vrablik
*Assistant Examiner*—David L. Cavanaugh
*Attorney, Agent, or Firm*—Spencer, Frank & Schneider

[57] ABSTRACT

A rotary vane vacuum pump includes a pump housing; a bearing support having a bearing bore; a drive motor having an output shaft extending into the bearing bore; and a pump rotor accommodated in the pump housing and having a rotor shaft extending into the bearing bore. The rotor shaft and the output shaft have respective radial end faces oriented towards one another and the output shaft and the rotor shaft have identical diameters. There is further provided a torque-transmitting coupling connecting the output shaft with the rotor shaft at respective radial end faces thereof; a first sealing ring situated in the bore and sealingly surrounding the output shaft; a second sealing ring situated in the bore and sealingly surrounding the rotor shaft; and a lubricant chamber formed by a part of the bearing bore and being bounded and sealed by the first and second sealing rings.

10 Claims, 2 Drawing Sheets

ROTARY VANE VACUUM PUMP WITH SHAFT SEAL

BACKGROUND OF THE INVENTION

This invention relates to a rotary vane vacuum pump which has a housing, a pump rotor and a motor drivingly connected with the pump rotor. The pump rotor and the drive motor have respective stub shafts which are arranged end-to-end in the housing and are connected to one another by a coupling.

The connection of the drive motor to the pump rotor as well as the oil-sealing of the drive are effected, as a rule, by means of a great number of components. The coupling usually comprises two coupling halves as well as an elastomer element including adjusting springs and screw connections. Further, separate shield members for the motor bearing and the rotary bearing as well as a coupling housing are provided. It is further necessary to provide the stub shafts with shaft sealing rings. For this purpose conventionally shaft seal bearing boxes are used. The individual structural components have to be manufactured separately which is not only technologically complex and thus expensive but may lead to tolerance accumulations which may adversely affect the precise circular run of the components.

In German Offenlegungsschrift (application published without examination) 23 54 039 a rotary vane vacuum pump of the above-outlined type is described. The separately supported motor stub shaft is provided with a bearing box which is slidably supported in a bore of the coupling housing. The bearing box is provided with shaft seal rings between which a lubricant chamber is provided. At its end the bearing box is connected by means of a pin coupling with the rotor stub shaft which has an enlarged diameter. In such a known pump out-of-round runs have been experienced which require a soft support of the pins of the pin coupling in at least one of the parts that are to be connected with one another. This measure further adds to the manufacturing expense. Further, difficulties have been experienced in supplying lubricant to the stub shaft of the pump rotor. It has been found that the reason for this difficulty is the immediate vicinity of the pumping chamber of the rotor to the surfaces of the rotor bearing which are to be supplied with oil. Since it is desirable to provide a full lubrication for the slide bearings, lubricating oil continuously gains access to the pumping chamber and thus adversely affects the efficiency of the pump.

SUMMARY OF THE INVENTION

It is an object of the invention to provide an improved coupling between the drive motor and the pump rotor which is significantly simpler and more economical than prior art constructions.

This object and others to become apparent as the specification progresses, are accomplished by the invention, according to which, briefly stated, the rotary vane vacuum pump includes a pump housing; a bearing support having a bearing bore; a drive motor having an output shaft extending into the bearing bore; and a pump rotor accommodated in the pump housing and having a rotor shaft extending into the bearing bore. The rotor shaft and the output shaft have respective radial end faces oriented towards one another and the output shaft and the rotor shaft have identical diameters. There is further provided a torque-transmitting coupling connecting the output shaft with the rotor shaft at respective radial end faces thereof; a first sealing ring situated in the bore and sealingly surrounding the output shaft; a second sealing ring situated in the bore and sealingly surrounding the rotor shaft; and a lubricant chamber formed by a part of the bearing bore and being bounded and sealed by the first and second sealing rings.

By virtue of the above-outlined features of the invention the number of the structural components necessary for providing a bearing support and a connection between the drive motor and the pump rotor is reduced to a minimum and also, the pump noise is reduced. A separate bearing shield with bearings for the drive motor in the zone of the coupling is no longer necessary and furthermore, the problem concerning the lubrication of the pump rotor bearing is eliminated. The sealing ring associated with the pump rotor stub shaft is situated in the immediate vicinity of the pumping chamber so that no difficulties are encountered to provide the lubricant chamber between the sealing rings with a full lubrication and to operate the adjoining pumping chamber with a reduced lubrication. The invention even provides the possibility to position the high-vacuum stage of a two-stage vacuum pump (which high-vacuum stage is operated with very little oil) immediately adjacent the coupling and bearing zones which are operated with a full lubrication.

DESCRIPTION OF THE PREFERRED EMBODIMENT

Figure 1:
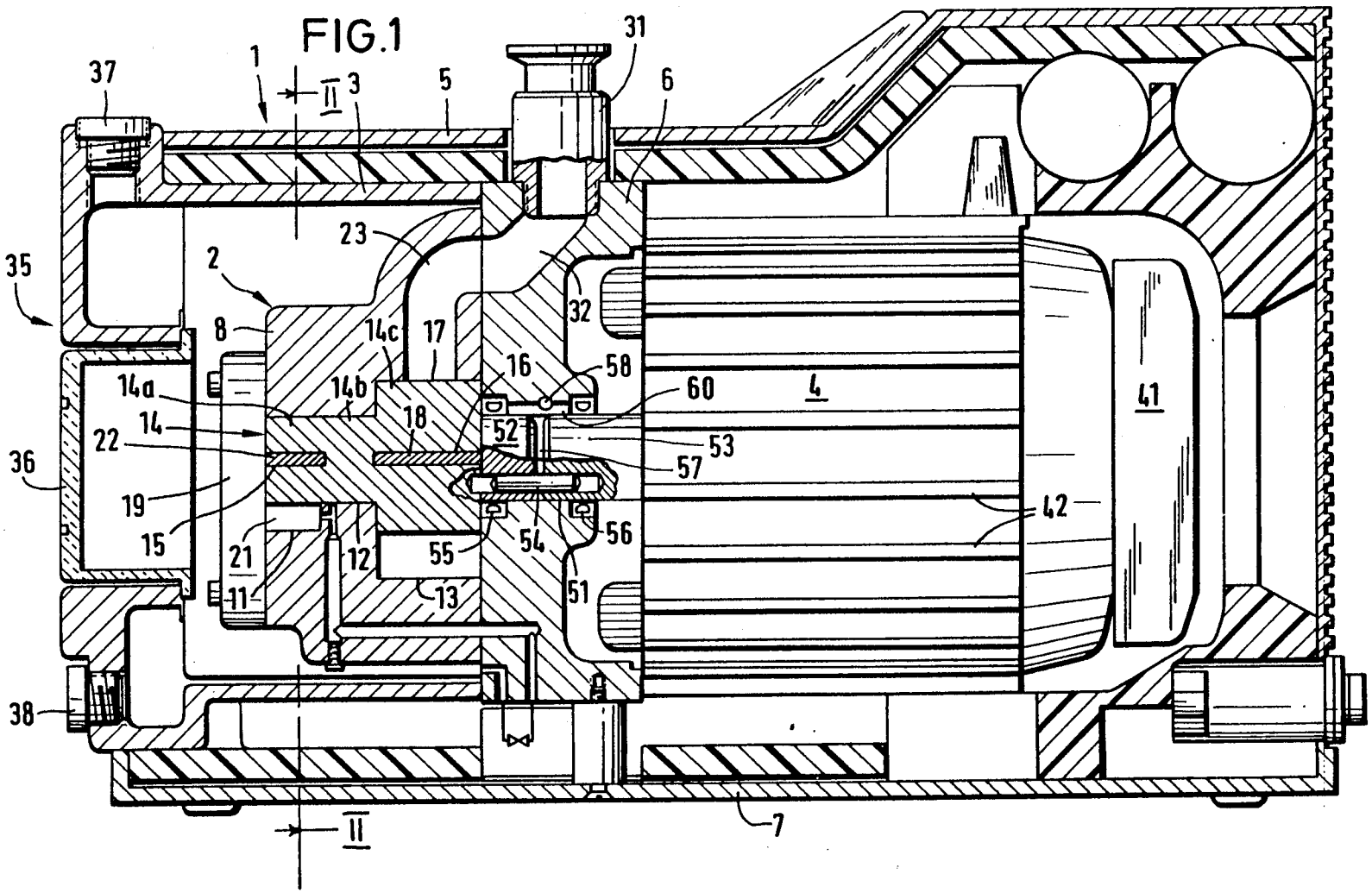
FIG. 1 is an axial sectional view of a preferred embodiment of the invention, taken along line I—I of FIG. 2.
Figure 2:
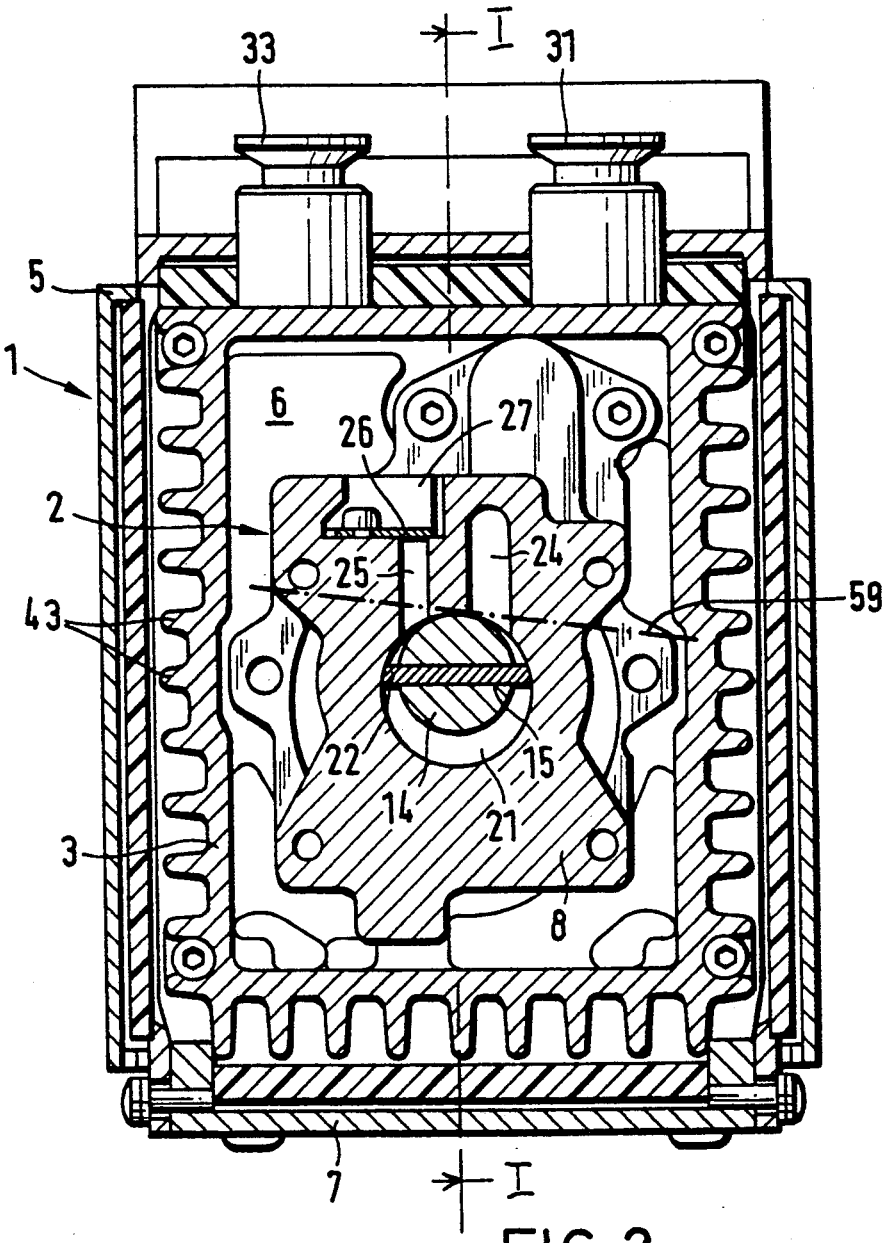
FIG. 2 is a sectional view taken along line II—II of FIG. 1.

Turning to FIGS. 1 and 2, the two-stage rotary vane vacuum pump shown therein and generally designated at 1 includes a pump housing 2, an oil casing 3 surrounding the pump housing 2, a drive motor 4 and an outer housing or pump cover 5. The pump housing 2 and the drive motor 4 are mounted on a separating shield (partition) 6 which, in turn, is secured to a base plate 7 supported on a floor.

The pump housing 2 includes a one-piece pump ring 8 which has a throughgoing opening having three consecutive zones 11, 12 and 13 of different configurations. In the ring opening 11, 12, 13 there is disposed a one piece rotor assembly 14 which has axially consecutive parts 14*a*, 14*b* and 14*c*. The two outer parts 14*a* and 14*c* are provided with vane slots 15, 16 at their end faces and form the armature of the high vacuum stage (hereafter "HV-storage") and the pre-vacuum stage (hereafter "PV-stage"), respectively.

The mid portion 14*b* of the rotor assembly 14 corresponds in length and diameter to the mid zone 12 of the opening of the pump ring 8 such that this zone functions as a slide bearing for the rotor assembly 14. The opening zone 13 of the pump ring 8 is enlarged relative to the zone 12 and constitutes, together with the shield 6, the pump chamber 17 of the HV-stage in which the rotor part 14*c*, carrying a vane 18, is disposed. The zone 11 of the pump ring 8 constitutes, together with a frontal plate 19, the pump chamber 21 of the PV-stage in which the rotor part 14*a*, carrying a vane 22, is disposed. The HV-stage has an inlet channel 23, and a channel 24 extends from the outlet of the HV-stage to the inlet of the PV-stage. The PV-stage has an outlet channel 25, associated with an outlet check valve 26 which is situated at the upper part of the pump housing 2 and, in case of a pump breakdown, preserves the vacuum in the vessel under evacuation. A depression 27 is provided in the top face of the housing 2 for serving as an intermediate oil sump during the operation of the vacuum pump, as it will be explained later.

An inlet nipple 31 of the vacuum pump is secured to the shield 6 in which a port 32 is provided, connecting the inlet nipple 31 to the inlet channel 23 of the HV-stage. The shield 6 also carries an outlet nipple 33 which is connected by a non-illustrated port that is similar to the port 32, with the inner space of the oil casing 3.

The oil casing 3 has an end face structure 35, whose central portion 36 is transparent and serves for monitoring the oil level in the oil casing 3. The end face structure 35 has an approximately semicircular cross section, whose wide side is oriented towards the oil casing 3. The end face structure 35 extends over the entire height of the oil casing 3 and is provided with an oil filling opening 37 and an oil drain 38.

The motor 4 is provided with a blower 41 at its end face oriented away from the pump structure proper. The cold air flow generated by the blower 41 serves for cooling both the motor 4 and the oil casing 3. The housing of the motor 4 and the oil casing 3 are both provided with axially or horizontally oriented cooling ribs 42 and 43, respectively.

The separating shield 6 further functions as a coupling housing. It has a throughgoing bearing bore 51 rotatably receiving a stub shaft (rotor shaft) 52 of the rotor assembly 14 and a stub shaft (output shaft) 53 of the drive motor 4. The two stub shafts 52 and 53 are connected at their radial faces by means of a pin coupling formed of pins 54. It is to be understood that instead of a pin coupling, interengaging projections in the end faces of the stub shafts 52 and 53 may be provided.

Both the pump rotor stub shaft 52 and the drive motor stub shaft 53 may be slidably supported in the bearing bore 51. It is, however, feasible to arrange only one of the two stub shafts—preferably the pump rotor stub shaft 52 —slidably in the bearing bore 51 and to support the other stub shaft (preferably the drive motor stub shaft 53) in the coupling elements. The axially extending and eccentric pin or pins 54 of the pin coupling may be fixedly secured in their respective bores in the pump rotor stub shaft 52 while they extend with a slight play into the respective bores of the drive motor stub shaft 53. In case the pump rotor stub shaft 52 is slidably held in the bearing bore 51, the drive motor stub shaft 53 may be held exclusively by the pins of the pin coupling.

Each stub shaft 52 and 53 is associated with a respective shaft seal ring 55 and 56, seated in the shield 6. The seals 55 and 56 define between themselves a central lubricant chamber 57 which contains the pin coupling (formed of the pins 54) that may be fully lubricated through an oil port 58. Since the rotor-side shaft seal ring 55 is situated in the immediate vicinity of the HV-stage, the output of this stage, operated with the above-described reduced lubrication, is not adversely affected by the lubricant.

The position of the oil bore 58 is shown in FIG. 2 by a dash-dot line 59. The oil bore 58 passes—preferably at an inclination—through the pump housing 2 and intersects the lubricant chamber 57 above the stub shafts 52 and 53 in the zone of the shaft coupling formed by pins 54. Expediently, in this zone there extends an axially parallel groove 60 provided in the bearing and coupling housing (shield) 6. The oil is introduced into the lubricant chamber 57 through the bore 58. Excess oil flows further through the bore 58 and is introduced into the lower-lying oil sump. From the lubricant chamber 57 oil can never flow out entirely; as a result, the bearing support and coupling according to the invention has particularly advantageous emergency run properties.

It will be understood that the above description of the present invention is susceptible to various modifications, changes and adaptations, and the same are intended to be comprehended within the meaning and range of equivalents of the appended claims.

What is claimed is:

1. A rotary vane vacuum pump comprising (a) a pump housing;

(b) a drive motor including an output shaft having a radial end face;

(c) an outer housing accommodating said pump housing and said drive motor in a juxtapositioned relationship;

(d) a pump rotor accommodated in said pump housing and having a rotor shaft having a radial end face oriented towards the radial end face of said output shaft; said output shaft and said rotor shaft having identical diameters;

(e) a partition positioned between said drive motor and said pump housing and constituting a sole separation between said drive motor and said pump rotor;

(f) a bearing bore provided in said partition and receiving said output shaft and said rotor shaft;

(g) a torque-transmitting coupling connecting the output shaft with the rotor shaft at respective said radial end faces thereof;

(h) a first sealing ring situated in said bearing bore and sealingly surrounding said output shaft;

(i) a second sealing ring situated in said bearing bore and sealingly surrounding said rotor shaft; and (j) a lubricant chamber formed by a part of said bearing bore and being bounded and sealed by said first and second sealing rings.

2. A rotary vane vacuum pump as defined in claim 1, further comprising an oil conduit provided in said partition; said oil conduit passing above the output shaft and the rotor shaft and being in communication with said lubricant chamber.

3. A rotary vane vacuum pump as defined in claim 2, further comprising a groove provided in said partition and extending parallel to said output shaft and said rotor shaft; said oil conduit intersecting said groove.

4. A rotary vane vacuum pump as defined in claim 1, wherein said coupling comprises a pin received in the output shaft and the rotor shaft and extending between respective radial end faces of said output shaft and rotor shaft.

5. A rotary vane vacuum pump as defined in claim 4, wherein said pin is fixedly held in said rotor shaft and extends with a play into a bore provided in the radial end face of said output shaft.

6. A rotary vane vacuum pump as defined in claim 1, wherein one of said shafts journals in said bearing bore by rotationally slidingly engaging a cylindrical wall face defining said bearing bore; said cylindrical wall face constituting said means for defining said bearing bore.

7. A rotary vane vacuum pump as defined in claim 6, wherein the other of said shafts is exclusively held by said coupling.

8. A rotary vane vacuum pump as defined in claim 7, wherein said one shaft is said rotor shaft.

9. A rotary vane vacuum pump comprising (a) a pump housing;

(b) a bearing support including means for defining a bearing bore therein;

(c) a drive motor having an output shaft extending into said bearing bore; said output shaft having a radial end face;

(d) a pump rotor accommodated in said pump housing and having a rotor shaft extending into said bearing bore; said rotor shaft having a radial end face oriented towards the radial end face of said output shaft; said output shaft and said rotor shaft having identical diameters;

(e) a torque-transmitting coupling connecting the output shaft with the rotor shaft at respective said radial end faces thereof; the coupling comprising a pin received in the output shaft and the rotor shaft and extending between respective radial end faces of said output shaft and rotor shaft; said pin being fixedly held in said rotor shaft and extending with a play into a bore provided in the radial end face of said output shaft;

(f) a first sealing ring situated in said bore and sealingly surrounding said output shaft;

(g) a second sealing ring situated in said bore and sealingly surrounding said rotor shaft; and (h) a lubricant chamber formed by a part of said bearing bore and being bounded and sealed by said first and second sealing rings.

10. A rotary vane vacuum pump as defined in claim 9, wherein said bearing support comprises a partition separating the pump rotor from said drive motor.

* * * * *